US006695171B2

(12) United States Patent
Walters et al.

(10) Patent No.: US 6,695,171 B2
(45) Date of Patent: Feb. 24, 2004

(54) PUMP DISPENSER

(75) Inventors: Peter J. Walters, Barrington, IL (US); John P. Hinson, Crystal Lake, IL (US)

(73) Assignee: Seaquistperfect Dispensing Foreign, Inc., Crystal Lake, IL (US)

( * ) Notice: Subject to any disclaimer, the term of this patent is extended or adjusted under 35 U.S.C. 154(b) by 117 days.

(21) Appl. No.: 10/074,367

(22) Filed: Feb. 12, 2002

(65) Prior Publication Data

US 2003/0150876 A1 Aug. 14, 2003

(51) Int. Cl.[7] ..... B67B 5/00

(52) U.S. Cl. ..... 222/153.13; 222/321.9; 222/384

(58) Field of Search ..... 222/321.7, 153.13, 222/384, 153.11, 321.9

(56) References Cited

U.S. PATENT DOCUMENTS

| | | | | |
|---|---|---|---|---|
| 3,348,740 | A | * 10/1967 | O'Donnell | 222/153.06 |
| 3,422,996 | A | 1/1969 | Lipman | |
| 3,669,300 | A | 6/1972 | Thomas | |
| 3,797,705 | A | 3/1974 | Cooprider | |
| 3,827,605 | A | 8/1974 | Knickerbocker | |
| 3,827,606 | A | 8/1974 | Knickerbocker | |
| 4,024,988 | A | 5/1977 | Starrett | |
| 4,162,746 | A | 7/1979 | Anderson et al. | |
| 4,286,736 | A | 9/1981 | Corsette | |
| 4,318,498 | A | 3/1982 | Magers et al. | |
| 4,324,351 | A | 4/1982 | Meshberg | |
| 4,340,158 | A | 7/1982 | Ford et al. | |
| 4,343,417 | A | 8/1982 | Corsette | |
| 4,355,962 | A | 10/1982 | Magers | |
| 4,368,830 | A | 1/1983 | Soughers | |
| 4,369,899 | A | 1/1983 | Magers et al. | |
| 4,375,266 | A | 3/1983 | Magers | |
| 4,384,660 | A | 5/1983 | Palmisano et al. | |
| 4,424,919 | A | 1/1984 | Knox et al. | |
| 4,479,589 | A | 10/1984 | Ford | |
| 4,496,085 | A | 1/1985 | Ford et al. | |
| 4,512,501 | A | 4/1985 | Foster | |
| 4,538,748 | A | 9/1985 | Ford et al. | |
| 4,589,574 | A | 5/1986 | Foster | |
| 4,865,228 | A | 9/1989 | Landecker | |
| 4,991,746 | A | 2/1991 | Schultz | |
| 5,388,730 | A | 2/1995 | Abbott et al. | |
| 5,445,299 | A | 8/1995 | Harriman | |
| 5,615,806 | A | 4/1997 | Grothoff | |
| 5,772,080 | A | 6/1998 | de Pous | |
| 5,829,641 | A | 11/1998 | Bartsch et al. | |
| 5,918,774 | A | 7/1999 | Lund et al. | |
| 6,006,949 | A | 12/1999 | Foster et al. | |
| 6,053,371 | A | 4/2000 | Durliat et al. | |
| 6,065,647 | A | 5/2000 | Bliss, III et al. | |
| 6,119,902 | A | 9/2000 | Shimada et al. | |
| 6,126,044 | A | 10/2000 | Smith | |
| 6,173,863 | B1 | 1/2001 | Brozell et al. | |
| 6,186,364 | B1 | 2/2001 | Dobbs | |
| 6,186,365 | B1 | 2/2001 | DeJonge | |
| 6,193,112 | B1 | 2/2001 | Santagiuliana | |
| 6,601,735 | B2 * | 8/2003 | Milian et al. | 222/153.11 |

FOREIGN PATENT DOCUMENTS

| | | |
|---|---|---|
| EP | 0 187 314 A2 | 7/1986 |
| EP | 1 023 946 A2 | 8/2000 |

* cited by examiner

*Primary Examiner*—Philippe Derakshani
(74) *Attorney, Agent, or Firm*—Wood, Phillips, Katz, Clark & Mortimer

(57) ABSTRACT

A finger-operable pump cartridge is disposed within a closure for mounting the pump cartridge and closure to a container of fluent material. An actuator is mounted on the stem of the pump cartridge and has a skirt with a flange extending from, and continuously around, the skirt. A shroud is mounted around the closure and has a lip for engaging the actuator flange to inhibit removal of the actuator from the stem if the actuator is moved outwardly relative to the stem beyond a predetermined position. The actuator and closure may also include cooperating interengageable features accommodating rotation of the actuator relative to the closure between an actuatable position permitting reciprocation of the actuator and a releasably locked position preventing reciprocation of the actuator.

19 Claims, 8 Drawing Sheets

140
44
44
43
50
52
42
90
46
90
130
40
130
120
132
80
92
132
11
11
84
74
86
72
100
58
59
36
29
38
30
54
32
26
70
28
24
34

PUMP DISPENSER

TECHNICAL FIELD

The present invention relates generally to a finger-operable pump dispensing package for fluent material. The invention more particularly relates to an assembly of components for mounting to a container to dispense fluent material from the container. The invention also relates to a process for assembling the components.

BACKGROUND OF THE INVENTION AND TECHNICAL PROBLEMS POSED BY THE PRIOR ART

Finger-operable dispensing pumps are typically adapted to be mounted on hand-held containers. Such containers are commonly used for liquid or paste products, such as household and automotive cleaners, industrial preparations, and personal care products such as hair sprays, deodorants, colognes, and the like. Typically, some pumps operate with a suitable discharge structure, such as a mechanical break-up unit, to produce a fine mist or atomized spray, and other pumps operate to dispense a quantity of product in a liquid, cream, or paste form.

Finger-operable pumps conventionally employ a pump cartridge having a chamber in which is disposed a pressurizing piston that can be actuated by pressing down on an external actuator, button, or plunger which is connected to the piston with a hollow discharge tube or stem. The hollow stem establishes communication between the pump chamber and actuator from which the product is discharged. A spring acts against the piston or actuator to return the piston and actuator upwardly to the elevated, rest position when the finger pressing force is released.

One type of conventional spray pump package includes (1) a container holding the liquid contents, and (2) a product discharge assembly which includes a pump cartridge mounted at the top of the container with a closure. The pump cartridge includes an outwardly projecting product-dispensing stem. An actuator or button is mounted on the pump cartridge stem. A peripheral shroud may be mounted around the closure at the top of the pump cartridge.

Pump packages or dispensers are widely used for dispensing liquid products which may be cosmetic products, food products, pharmaceutical products, and personal care products. Typically, a pump dispenser for a relatively viscous product, such as a lotion or hair gel, is provided with some sort of locking mechanism to render the actuator or button inoperable by latching the button in a particular position which must be released by the user performing a manipulation on the button or latch mechanism. This insures that the product is not dispensed accidentally during shipping or storage when the pump actuator button might be subjected to inadvertent impact.

Locking mechanisms have not generally been widely used for dispensing pumps employed with low viscosity products. Low viscosity products, such as hair spray, are typically dispensed from a fine mist type of pump. Generally such fine mist pumps are provided with a hood, overcap, or other cover that prevents the actuator form being actuated unintentionally during shipping or storage. However, even a hood can be knocked off of the package, and that would leave the actuator unprotected such that the actuator could be inadvertently bumped and perhaps partially depressed or actuated.

In those designs where a hood is employed, the disadvantages are that such a hood is an additional component that must be provided by the manufacturer, and the hood must subsequently be removed from the pump by the user (and perhaps retained by the user for subsequent replacement on the pump).

In some types of pump dispensers, whether or not a hood or overcap is provided, the button or actuator mounted to the dispensing pump stem might be relatively easily pulled off (after any hood is removed), or otherwise separated from, the dispensing pump stem. In many applications, it would be desirable to provide a system that would make the removal of the actuator or button from the stem more difficult. Further, such an actuator retention system or feature should accommodate ease of manufacture, and should preferably not otherwise hinder or degrade normal operation. Further, such an actuator retention system should preferably accommodate the optional use of an actuator locking system to prevent operation of the actuator when the pump dispensing package is being shipped or stored or is otherwise not in use.

It would be desirable to provide an improved pump-type product discharge assembly for a dispensing package which could be readily employed on a variety of pumps, including fine mist spray-type pumps. Such an improved assembly should minimize the likelihood of the actuator or button being inadvertently separated from the dispensing pump.

Preferably, the improved pump-type product discharge assembly should offer a relatively robust design to prevent dislodgement of the actuator from the package during impact, such as when the package is dropped or bumped.

It would also be desirable to provide an improved method for assembling the components of an improved discharge assembly for a pump dispensing package. Such an improved method should not require an excessive number of manufacturing steps and should permit the components to be readily put together as an assembly that can be readily installed on a container.

The improved product discharge assembly should also accommodate use with standard containers or bottles, including bottles with conventional threads or custom threads as well as different connection mechanisms.

It would also be desirable to optionally provide an improved pump-type product discharge with not only an actuator retention system, but also with an actuator locking system assembly which would not require a special hood to cover the top of the actuator to protect the actuator from being prematurely actuated during shipping or storage. The elimination of such a hood would reduce the product cost.

Even where an actuator retention system is not provided, it may be desirable in some applications to provide at least an improved locking mechanism for preventing the actuator from being unintentionally actuated. Such an improved locking mechanism should have a robust structure that provides a tactile indication to the user that the locked and unlocked positions are being reached as the components are manipulated by the user.

It would also be beneficial if an improved product discharge assembly for a pump dispensing package could accommodate incorporation of a more aesthetically pleasing design.

It would also be desirable to provide an improved design of the assembly constituent components which could be relatively easily molded and that would facilitate economical manufacture, high production quality, and consistent operating parameters unit-to-unit with high reliability.

Such an improved design should also desirably provide a system which can be economically assembled and installed by automatic equipment and which will not require the user to effect a final assembly step.

Such an improved system should also desirably accommodate designs which would protect the user's finger from injury or discomfort during actuation of the pump.

The present invention provides an improved system which can accommodate designs having the above-discussed benefits and features.

SUMMARY OF THE INVENTION

The present invention provides a pump-type product discharge assembly which can be incorporated as part of a pump dispensing package.

According to one aspect of the invention, the product discharge assembly includes a finger-operable pump cartridge having a product discharge stem, a closure for mounting the pump cartridge on a container, an actuator for mounting on the stem of the pump cartridge, and a shroud surrounding portions of the pump cartridge, closure, and actuator.

The assembly makes removal of the actuator from the pump cartridge stem more difficult. The design of the assembly can be made relatively robust to tolerate impact on, or dropping of, the package with a reduced likelihood that the actuator will separate from the pump cartridge stem.

Further, the assembly can be optionally combined with additional design features that enable the actuator to be releasably locked in an inoperable condition. With such an additional locking design, the assembly must be manipulated by the user to reposition the actuator from a releasably locked condition to an unlocked condition so that the actuator can be subsequently actuated or operated to dispense product.

According to another aspect of the invention, a method is provided for making a product discharge assembly for a container of fluent material. The method accommodates less costly manufacturing techniques. The completed product discharge assembly can be readily installed on a container with conventional automatic installation equipment.

According to a presently preferred embodiment of a first aspect of the present invention, a product discharge assembly for a container of fluent material includes a finger-operable pump cartridge, a closure, an actuator, and a shroud. The finger-operable pump cartridge has an outwardly projecting, reciprocatable product dispensing stem biased to an elevated rest position. The pump cartridge is adapted to be installed in the mouth of a container.

The container has a connection feature adjacent the mouth (e.g., a thread, bead, or other suitable conventional or special connection feature). The closure is adapted for mounting around the pump cartridge on the container at the container mouth. The closure has a connection feature for mounting with the container connection feature to connect the closure to the container. The closure connection feature may be, for example, a thread for threadingly engaging a thread adjacent the mouth of the container. The closure may instead include different connection features, such as a bead or other conventional or special connection feature.

The closure includes a retention feature for engaging a portion of the pump cartridge to retain the pump cartridge on the container. The closure includes an opening into which the pump cartridge can project. The closure also has a peripheral engagement feature for engaging the shroud as discussed below.

The actuator is adapted to be mounted on the pump cartridge stem. The actuator has a dispensing passage for establishing fluid communication between the stem and the exterior of the actuator. The actuator includes a finger-engagable region that can be subjected to force imposed by a finger to urge the stem further into the pump cartridge. Further, according to one aspect of the invention, the actuator also includes a skirt with a flange extending from, and continuously around, the skirt.

The shroud has a central cavity open at opposite ends for receiving the closure and actuator mounted on the stem. The shroud has an internal engagement feature for engaging the closure peripheral engagement feature to secure the shroud to the closure. The shroud also has a lip for engaging the actuator flange to inhibit removal of the actuator from the stem if the actuator is moved outwardly relative to the stem beyond a predetermined position.

According to another aspect of the invention, a method is provided for making a product discharge assembly for a container of fluent material. The method includes the following steps:

(A) providing a finger-operable pump cartridge that (i) has an outwardly projecting, reciprocatable, product-dispensing stem biased to an elevated rest position, and (ii) is adapted to be installed in a mouth of a container that has a connection feature adjacent the mouth;

(B) providing a closure that is adapted for mounting on the container at the mouth and that has (i) a connection feature for mating with the container connection feature to connect the closure to the container, (ii) a retention feature for engaging a portion of the pump cartridge to retain the pump cartridge on the container, (iii) an opening into which the pump cartridge can project, and (iv) a peripheral engagement feature;

(C) providing an actuator that is adapted for being mounted on the stem and that has (i) a dispensing passage for establishing fluid communication between the stem and the exterior of the actuator, (ii) a finger-engagable region that can be subjected to force imposed by a finger to urge the stem further into the pump cartridge, and (iii) a skirt with a flange extending from, and continuously around, the skirt; and (D) providing a shroud having (i) a central cavity open at opposite ends for receiving the closure and actuator mounted on the stem, (ii) an internal engagement feature for engaging the closure peripheral engagement feature to secure the shroud to the closure, and (iii) a lip for engaging the actuator flange to inhibit removal of the actuator from the stem if the actuator is moved outwardly relative to the stem beyond a predetermined position;

(E) disposing the pump cartridge in the closure;

(F) installing the actuator on the stem; and (G) securing the shroud to the closure with at least portions of the pump cartridge, actuator, and closure received in the shroud central cavity to orient the shroud lip above the actuator flange.

According to another aspect of the invention, a novel product discharge assembly is provided for a container of fluent material, but the assembly need not have an actuator with a retention skirt. This independent novel aspect of the invention provides a releasable locking system for the actuator to prevent inadvertent actuation of the pump. The assembly includes a finger-operable pump cartridge that (i) has an outwardly projecting, reciprocatable, product-dispensing stem biased to an elevated rest position, and (ii) is adapted to be installed in a mouth of a container that has a connection feature adjacent the mouth.

The assembly also includes an actuator that is adapted for being mounted on the stem. The actuator includes (i) a dispensing passage for establishing fluid communication between the stem and the exterior of said actuator, (ii) a generally axially oriented rib that (a) projects radially inwardly from the actuator skirt, (b) has a lower end surface, and (c) has a lateral surface portion.

The assembly also includes a closure for mounting on the container at the mouth. The closure includes (i) a connection feature for mating with the container connection feature to connect the closure to the container, (ii) a retention feature for engaging a portion of the pump cartridge to retain the pump cartridge on the container, (iii) an opening into which the pump cartridge projects, (iv) a slot that (a) opens radially outwardly and is oriented generally parallel to the actuator reciprocation directions for receiving the rib, and (b) is defined at least in part by two spaced-apart sidewalls, (v) a generally axially oriented rear guide wall that (a) extends from the slot to a first circumferential location from the slot where the rear guide wall terminates in a first retention surface, and (b) defines a cam surface projecting further radially outwardly with increasing distance from the slot so that the rib engages the cam surface with increasing force as the rib moves along the cam surface away from the slot, (vi) an abutment surface that (a) extends from the slot to a second circumferential location that is further from the slot than is the first circumferential location, and (vii) a second retention surface projecting from the abutment surface at the second circumferential location to define a receiving space between the first and the second retention surfaces. The rear guide wall deflects the rib radially outwardly as the actuator is rotated to move the rib toward the receiving space whereby the rib is resiliently urged into the receiving space when the rib has been rotated past the first retention surface. This provides the user with a tactile sensation of increasing resistance as the actuator is rotated toward the locked position, at which locked position the actuator rib snaps into the receiving space.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
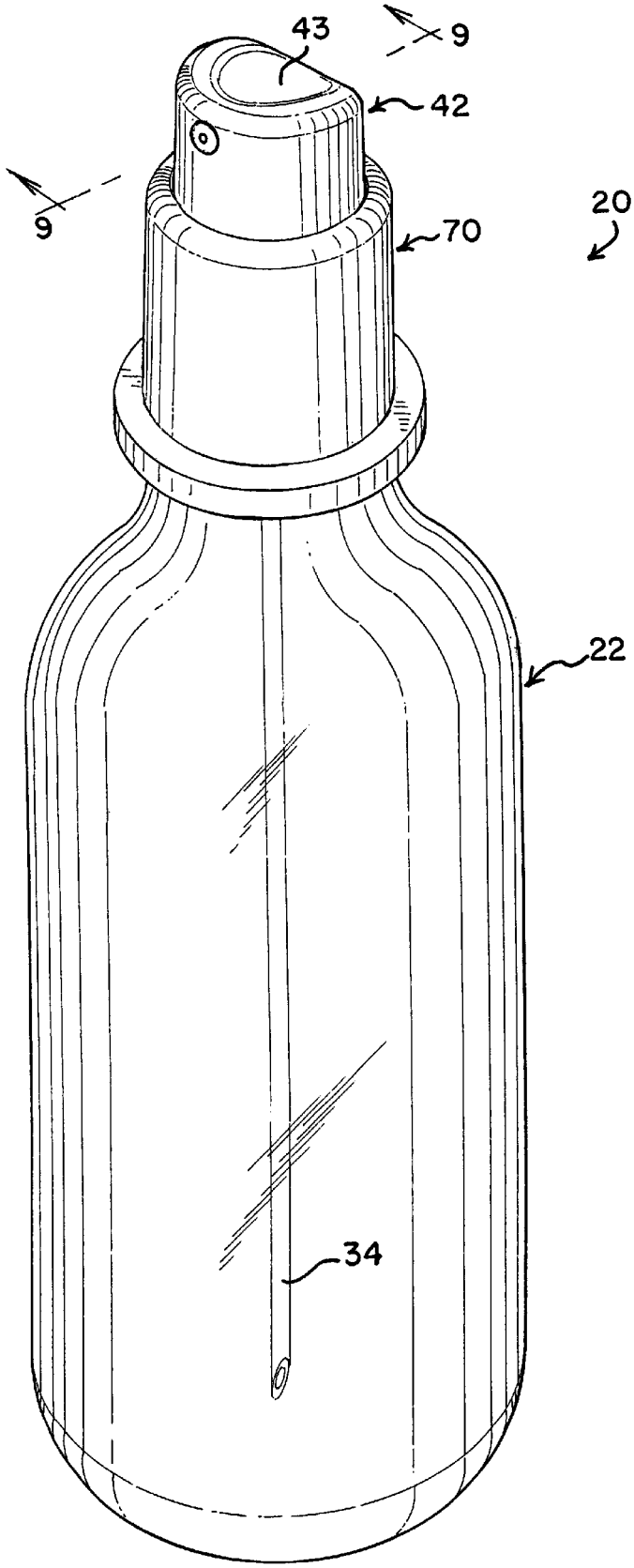
FIG. 1 is a perspective view of a first embodiment of a finger-operable pump dispensing package incorporating the product discharge assembly of the present invention, and the package is shown assembled in an unactuated, but releasably locked, condition prior to use.

FIG. 1 illustrates a package 20 employing an embodiment of the product discharge assembly of the present invention in which the assembly is installed on a container 22.

Figure 2:
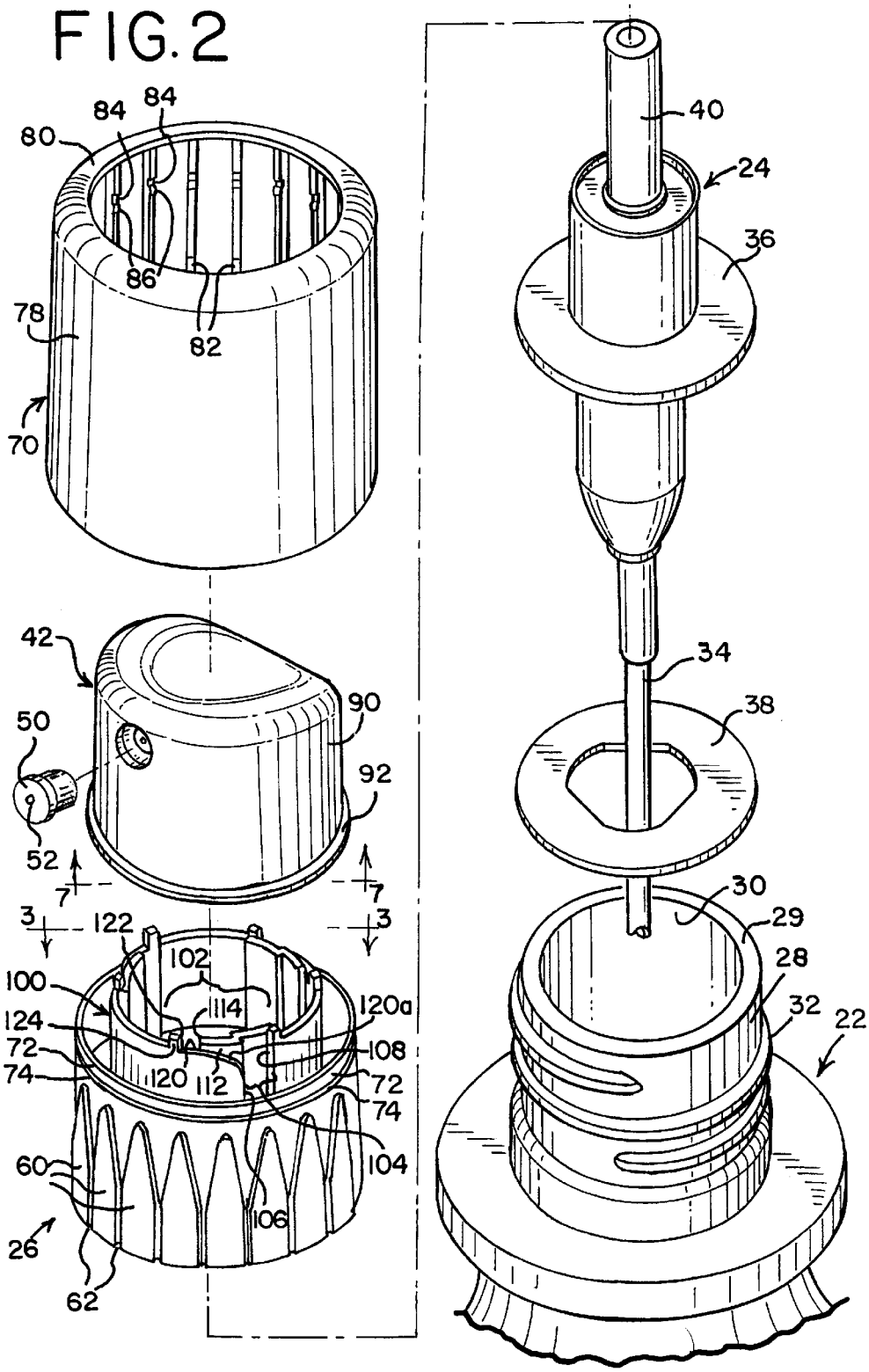
FIG. 2 is a fragmentary, exploded, perspective view of the package illustrated in FIG. 1.

FIG. 2 illustrates a typical pump or pump cartridge 24 that may be employed with a discharge assembly on the container 22 (FIG. 2) and which is adapted to be mounted with a closure 26 in the mouth of the container 22.

The container 22 is adapted to hold a product (typically a liquid (not shown) below the pump cartridge 24. Typically, the container 22 can be conveniently held in the user's hand.

The container 22 may be made of any suitable material, such as metal, glass, or plastic. A vacuum take-up piston (not illustrated) could be provided in the bottom of the container 22 if desired to assist in the dispensing of a product. The container 22 can have a reduced diameter neck 28 (FIG. 2) with a rim 29 defining a mouth or opening 30 into which the pump cartridge 24 is inserted.

The exterior of the container neck 28 typically defines the threads 32 for engaging the closure 26 as described in detail hereinafter. The threads 32 define a connection feature adjacent the container mouth 30. Other connection features may be employed in cooperation with mating or cooperating connection features on the closure 26, and such other connection features could be a snap-fit bead and groove arrangement or other conventional or special connection features, including non-releasable connection features such as adhesive, thermal bonding, staking, etc. . . .

Figure 9:
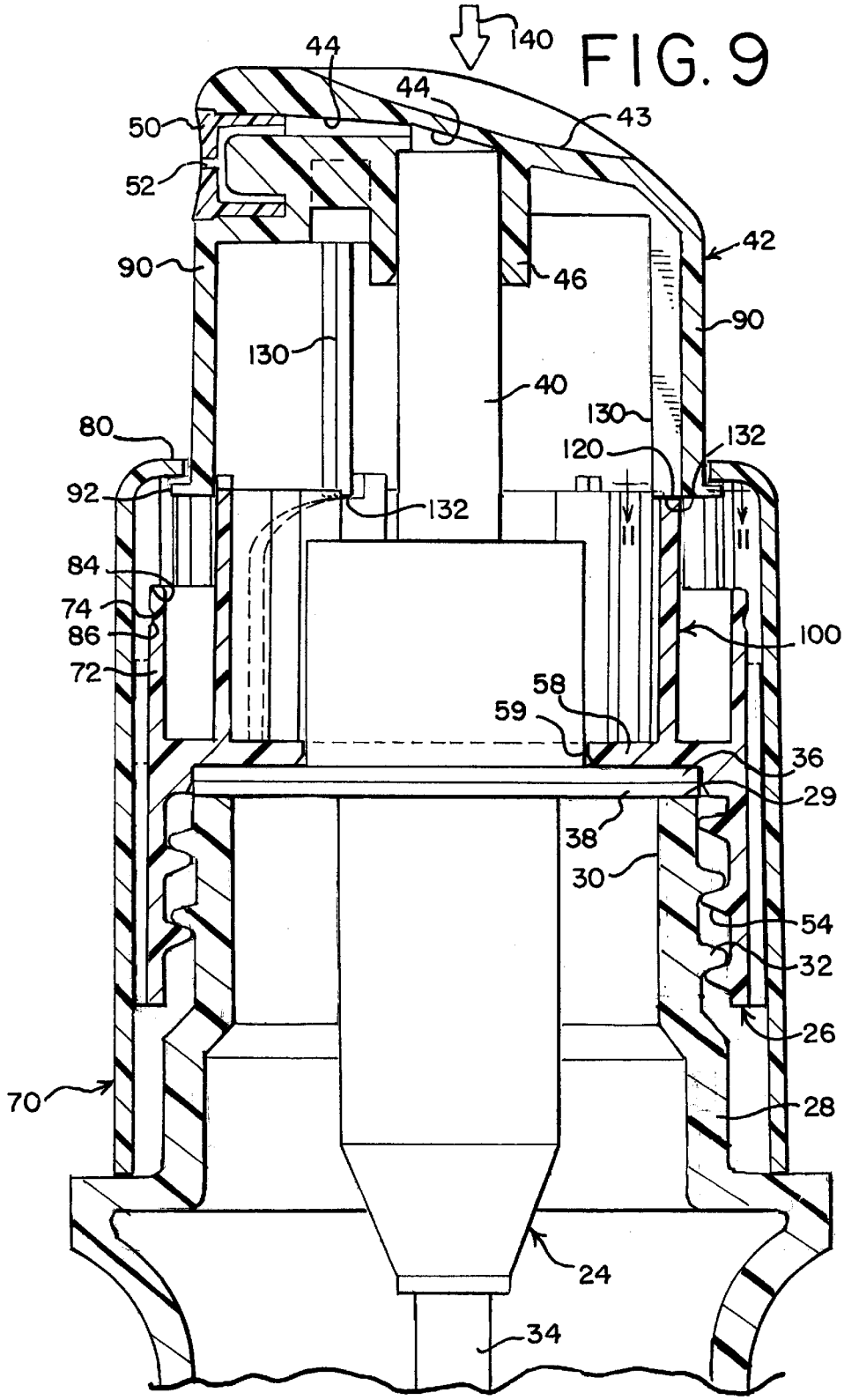
FIG. 9 is a greatly enlarged, fragmentary, cross-sectional view taken generally along the plane 9—9 in FIG. 1 but with a downwardly directed force on the actuator as might be applied to try to depress the actuator below the locked position.

A part of the pump cartridge 24 extends into the container opening or mouth 30. The pump cartridge 24 may be of any suitable conventional or special type. With a typical conventional pump cartridge 24, the bottom end of the pump cartridge 24 is attached to a conventional suction tube 34, and the upper end of the pump cartridge projects above the container neck 28 (FIG. 9). The pump cartridge 24 includes an outwardly projecting flange 36 for supporting the pump cartridge 24 on the container neck 28 over a conventional sealing gasket 38 (FIGS. 2 and 9) which is typically employed between the pump cartridge flange 36 and container neck rim 29.

The body of the pump cartridge 24 defines an interior chamber (not visible). In a typical pump cartridge 24, a pressurizing piston (not visible) is disposed in the upper end of the interior chamber, and a non-return check valve ball (not visible) is disposed in the lower end of the chamber. The pressurizing piston typically has an internal passage (not visible) which is connected to a hollow stem or discharge tube 40 (FIG. 2) which extends out through the top of the pump cartridge 24. The hollow stem or tube 40 establishes communication between the pump chamber within the pump cartridge 24 and an actuator 42 which is mounted to the upper end of the tube 40.

The actuator 42 defines a discharge passage 44 (FIG. 9) through which the product from the stem or tube 40 is discharged. The discharge passage 44 extends from an internal sleeve 46 defining an inlet cavity into which the terminal end or distal end of the tube 40 can be press-fit. The discharge passage 44 includes an outlet 48 (FIG. 8) into which can be press-fit a conventional mechanical breakup unit or spray insert nozzle 50 (FIG. 9) which has an exit orifice 52 (FIG. 9).

The actuator 42 has a finger-engageable region 43 (FIG. 1) and can be depressed by the user's finger to move the stem 40 downwardly (FIG. 10) in the pump cartridge 24 to dispense fluid from the pump cartridge 24. The fluid is pressurized in the pump chamber and exits as a fine mist spray from the nozzle orifice 52 in the nozzle 50.

Inside the pump cartridge 24, there is typically a spring (not visible) which acts against the piston inside the pump cartridge 24 to bias the piston, the tube 40, and the actuator 42 upwardly to an elevated rest position (FIG. 1) when the finger force is released.

After the pump cartridge 24 is actuated to dispense a liquid product as an atomized spray (by depressing the actuator 42 to move the tube 40 downwardly), the user releases actuator 42 so that the pump components are returned by the internal spring to the elevated, rest condition (FIG. 1). As the spring moves the pump piston upwardly in the pump cartridge 24, the internal check valve opens, and the fluid in the container 22 is drawn up into the cartridge 24 through the suction tube 34. The suction tube 34 typically extends to near the bottom of the container 22. The bottom end of the suction tube 34 is normally submerged in the fluid when the container 22 is in a generally upright orientation as illustrated in FIG. 1.

It will be appreciated that the particular design of the pump cartridge 24 may be of any suitable design for pumping a product from the container 22 (with or without a suction tube 34) and out through the stem 40. The detailed design and construction of the pump cartridge 24 per se forms no part of the present invention except to the extent that the pump cartridge 24 is adapted to be suitably mounted and held on the container by a closure 26 with a suitable mounting system.

While the present invention may be practiced with spray or liquid pumps of many different designs, the internal design configuration of one suitable pump is generally disclosed in U.S. Pat. No. 4,986,453, the disclosure of which is hereby incorporated herein by reference thereto. It should be understood, however, that the present invention is suitable for use with a variety of finger-operable pumps.

The closure 26 (FIGS. 2, 3, 4, and 5) has a female thread 54 (FIG. 4) defining a connection feature for mating with the container male thread 32 as shown in FIG. 9. The connection feature of the closure 26 may take other forms for mating with other forms of a connection feature on the container 22. For example, a snap-fit bead and groove arrangement could be employed, or some other suitable conventional or special connection arrangement could be employed.

The closure 26 includes an inwardly projecting flange 58 (FIG. 4) to define a retention feature wherein the flange 58 is adapted to overlie the pump cartridge flange 36 (FIG. 9) so as to clamp the pump cartridge flange 36 against the gasket 38 on the top of the container neck rim 29.

Figure 3:
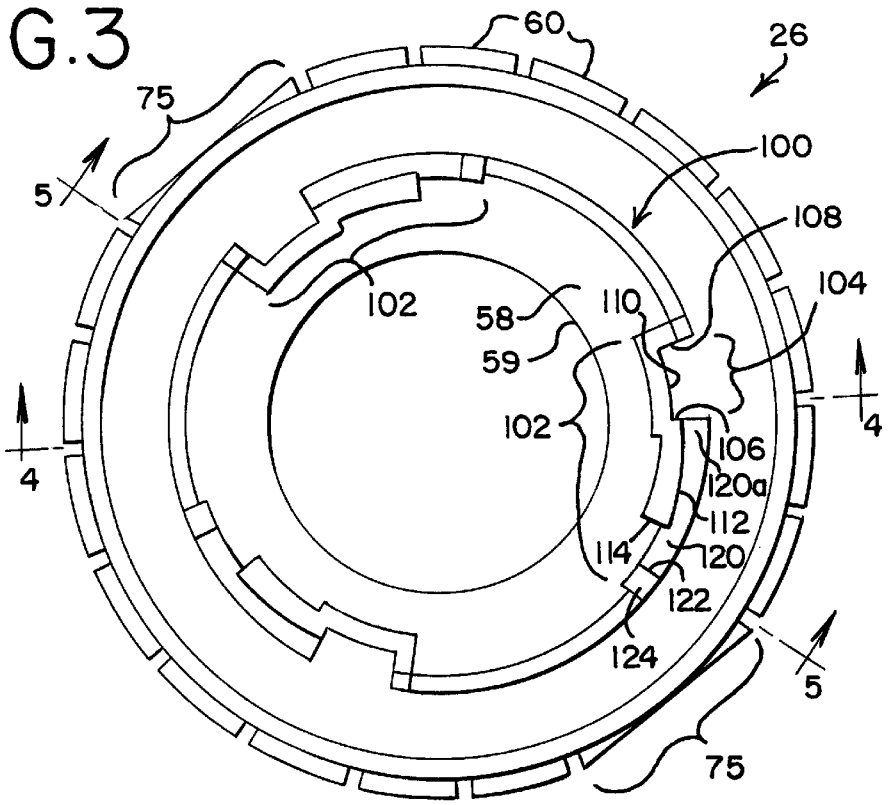
FIG. 3 is a greatly enlarged, plan view of the closure component of the product discharge assembly taken generally along the plane 3—3 in FIG. 2.
Figure 4:
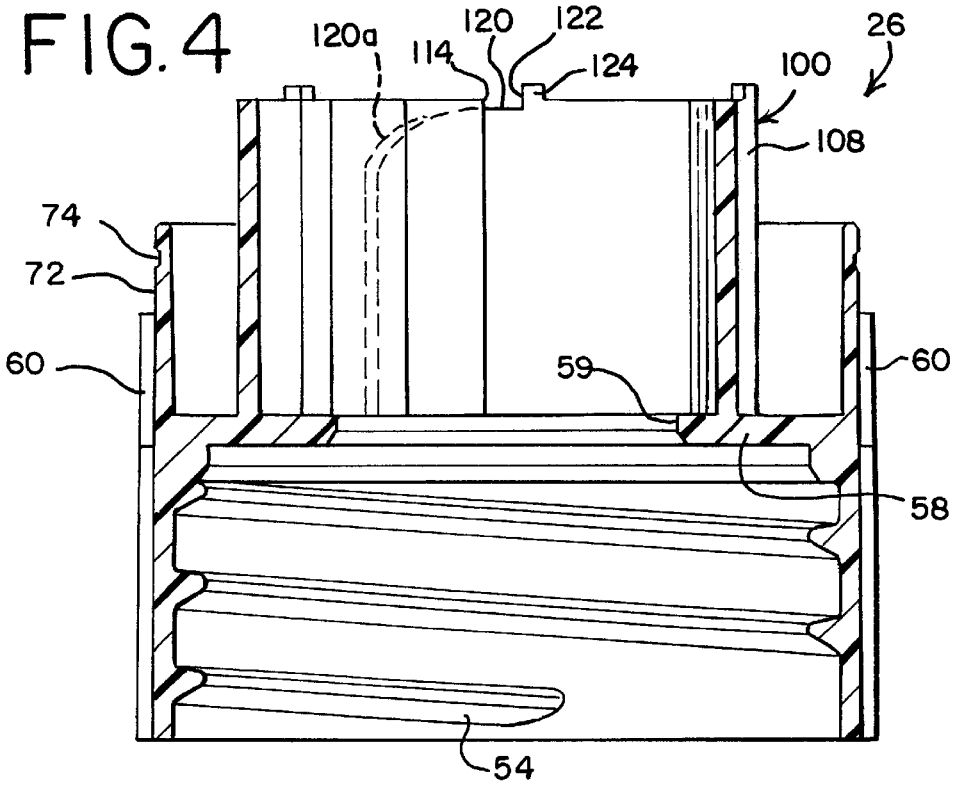
FIG. 4 is a cross-sectional view taken generally along the plane 4—4 in FIG. 3.

As shown in FIGS. 2 and 3, the closure 26 includes a peripheral engagement feature in the form of a plurality of spaced-apart anchoring protuberances 60. As can be seen in FIG. 2, adjacent protuberances define a groove, space, channel, or slot 62 between them. The upper end of each protuberance 60 has a somewhat triangular shape and therefore tapers or narrows in the upward direction so as to provide a tapered end entrance to each groove 62. The anchoring protuberances 60 are adapted to engage a surrounding shroud 70 (FIGS. 2 and 6) as described in detail hereinafter. The protuberances 60 are arranged in two groups or sets spaced 180 degrees apart and separated by two large gaps or spaces 75 as shown in FIG. 3. These two gaps or spaces 75 each have a flat formation at the bottom edge of the closure (see FIGS. 11 and 12), and these provide a system for orienting the components by machine during assembly and installation as described hereinafter.

The closure 26 is adapted to receive the shroud 70. To this end, the closure 26 has a generally cylindrical wall 72 (FIG. 4) from which the protuberances 60 project. The cylindrical wall 72 extends above the upper ends of the protuberances 60 and defines a circumferential groove 74 above the upper ends of the protuberances 60.

The shroud 70 is adapted to be received on the closure 26—after the pump 24 is positioned within the closure 26 and after the actuator 42 is mounted on the pump cartridge stem 40. As can be seen in FIG. 2, the shroud 70 has a generally cylindrical, annular wall 78 that terminates at its upper end in a radially inwardly extending lip 80. The lip 80 is preferably continuous, but may be discontinuous.

The shroud 70 has an internal engagement feature in the form of a plurality of ribs 82 (FIG. 2) which are preferably equally spaced circumferentially around the inside of the shroud 70. Each rib 82 is adapted to be received within one of the grooves 62 between adjacent anchor protuberances 60 of the closure 26. Each shroud rib 82 is slightly thicker than the vertical groove 62 in which it is received. The shroud 70 must be forced onto the closure 26 (or, alternatively, the closure 26 must be forced into the shroud 70) so that the shroud ribs 82 slide into the grooves 62. Typically, there is slight, local deformation of the edges of the protuberances 60 adjacent the grooves 62 as the ribs 82 slide into the grooves 62, and this results into a tight engagement between the shroud 70 and closure 26 which resists separation.

Further, each rib 82 has an upper shoulder portion 84 (FIGS. 2 and 9) which rests on the top of the closure cylindrical wall 72 when the shroud 70 is fully seated on the closure 26. In addition, as shown in FIG. 2, each shroud rib 82 has an inwardly projecting bump or bead 86 for being received in the closure wall groove 74 (as illustrated in FIG. 9). The configuration of the closure ribs 82, including the feature of the rib shoulders 84 and bumps or beads 86, establish the final, vertical assembly position of the shroud 70 relative to the closure 26. This arrangement, together with the engagement of the ribs 82 in the closure slots 62, establishes a final connection for effectively securing the shroud 70 to the closure 26 at a predetermined relative position of the two components. Other systems or structures could be provided for connecting the shroud 70 and closure 26 instead of the ribs 82 and protuberances 60. This could include snap-fit engagements, fasteners, thermal bonding, adhesive bonding, staking, etc.

The inner edge of the closure flange 58 defines an opening 59 (FIG. 4) for receiving an upper portion of the pump cartridge 24 as shown in FIG. 9. The closure 26 may thus be characterized as having an opening 59 into which the pump cartridge 24 can project.

When the shroud 70 is mounted on the closure 26 around both the pump cartridge 24 and actuator 42 as illustrated in FIG. 9, the shroud upper lip 80 extends inwardly toward, and is positioned adjacent, the bottom portion of the actuator 42. The actuator 42 includes a skirt 90 (FIGS. 2 and 9) with a flange 92 extending from, and continuously around, the skirt 90. The flange 92 is adapted to lie under the shroud lip 80 as shown in FIG. 9. Because the actuator 42 is mounted on the pump cartridge stem 40, and because the maximum upward location or elevation of the stem 40 is determined by the internal structure of the pump cartridge 24, the unactuated, rest elevation of the actuator 42 is predetermined according to the mounting relationship between the actuator 42 and stem 40. As shown in FIG. 9, the actuator 42 is mounted with the internal collar or sleeve 46 to the upper end of the pump cartridge stem 40. The mounting is typically effected with a friction fit, although other mounting arrangements may be employed, including staking, heat-bonding, adhesive bonding, etc. However, for ease of manufacture, and to keep costs to a minimum, a simple friction fit of the actuator 42 to the stem 40 is typically employed.

During installation of the assembly on the container to form the completed package, during shipping and handling of the package, and during use of the package, the actuator 42 may be subjected to impacts resulting from unintentional pumping or dropping. Such impacts could separate the actuator 42 from the stem 40 if it were not for the actuator flange 92 lying below the shroud lip 80. If the actuator 42 is subjected to an impact which tends to move the actuator 42 upwardly off of the stem 40, then the actuator flange 92 will engage the shroud lip 80, and this will prevent separation of the actuator 42 from the stem 40.

In addition to the actuator retention feature described above, the closure 26 and actuator 42 also may optionally be provided with a feature to prevent inadvertent actuation of the pump cartridge 24. This feature may be characterized as a releasable locking feature when the pump discharge assembly is in the unactuated, elevated, rest position (FIGS. 1 and 6) for preventing the actuator 42 from being pushed downwardly. A unique system for preventing such inadvertent actuation is next described. According to another aspect of the invention, the unique form of the locking system may also be employed in a package that does not have the above-described actuator retention feature.

Figure 5:
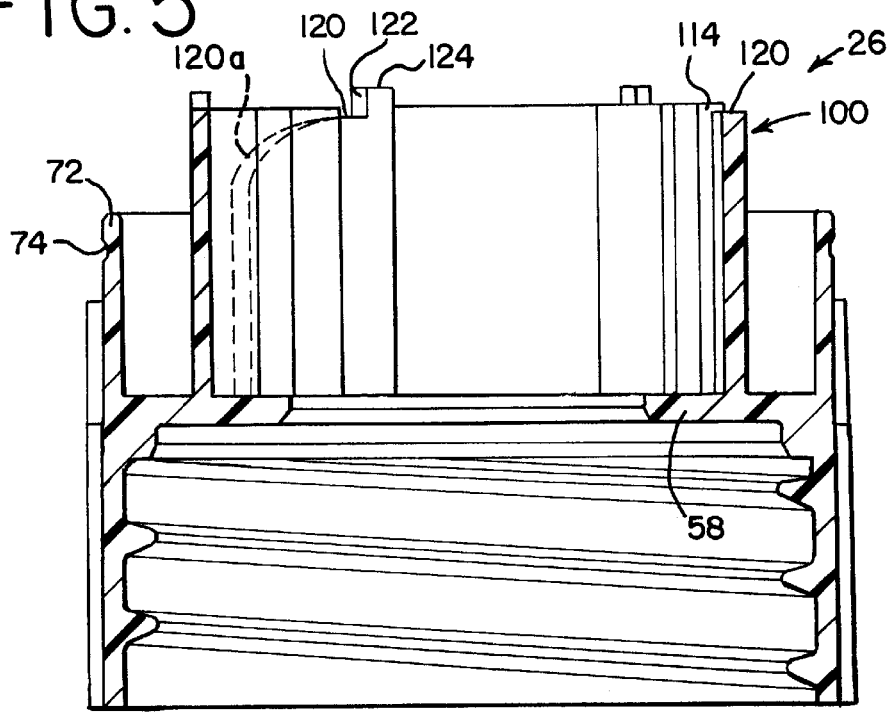
FIG. 5 is a cross-sectional view taken generally along the plane 5—5 in FIG. 3.

The actuator locking system includes interengageable features on the actuator 42 and closure 26 for accommodating rotation of the actuator 42 relative to the closure 26 between (1) an actuatable position (FIGS. 10 and 12) permitting reciprocation of the actuator 42, and (2) a releasably locked position (FIGS. 1, 9, and 11) preventing reciprocation of the actuator 42. As shown FIG. 2, the closure 26 includes an inner hub 100. As shown in FIGS. 3 and 5, the inner hub 100 has a generally annular configuration and projects upwardly from the closure flange 58. As shown in FIG. 3, the hub 100 has three identical portions 102 which are equally spaced apart circumferentially on the hub 100.

With reference to FIG. 2, the structure and features of one of the identical hub portions 102 is readily apparent. In particular, each hub portion 102 includes a generally vertically oriented, radially open groove, channel, or slot 104. With reference to FIG. 3, the slot 104 has a first sidewall 106 and a second sidewall 108 which are connected by a recessed back wall 110 that is located radially inwardly.

With reference to FIGS. 2 and 3, each hub portion 102 also includes a generally axially oriented rear guide wall 112 extending from the slot 104 to a first circumferential location from the slot 104 where the rear guide wall 112 terminates in a first retention surface 114. The first retention surface 114 is preferably oriented generally radially as can be seen in FIG. 3.

Each hub portion 102 also includes a generally upwardly facing abutment surface 120 (FIGS. 2 and 3) that (a) extends from the slot 104 to a second circumferential location that is further from the slot 104 than is the first circumferential location defined by the first retention surface 114. The abutment surface 120 has an arcuate portion 120*a* merging with the slot first sidewall 106. The abutment surface 120 and its arcuate portion 120*a* are generally perpendicular to the front surface of the rear guide wall 122.

As shown in FIGS. 2 and 3, a second retention surface 122 projects from the end of the abutment surface 120 at the second circumferential location beyond the first circumferential location of the first retention surface 114 so as to define a receiving space between the first retention surface 114 and the second retention surface 122. In the preferred embodiment, the second retention surface 122 is defined on the vertical side of a post 124 projecting upwardly on the hub 100 at the end of the abutment surface 120.

Figure 11:
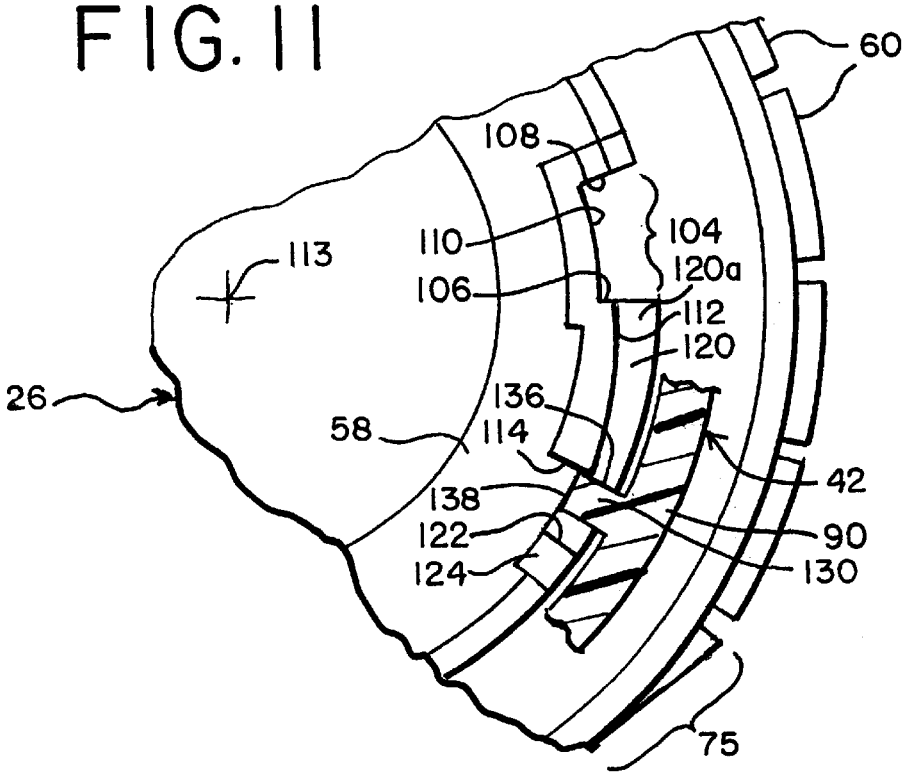
FIG. 11 is an enlarged, fragmentary view taken generally along the plane 11—11 in FIG. 9.
Figure 12:
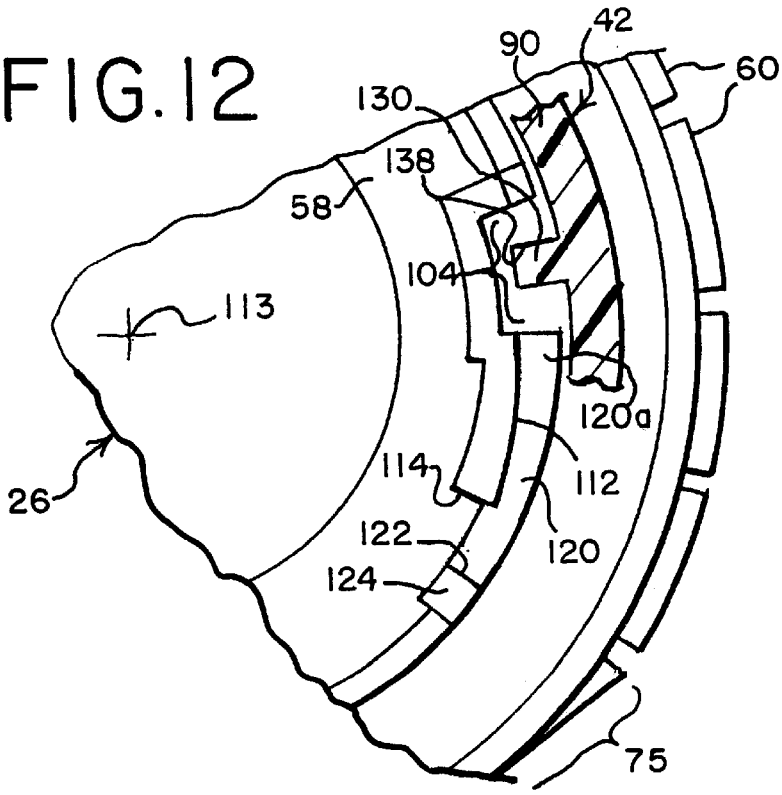
FIG. 12 is an enlarged, fragmentary view similar to FIG. 11, but FIG. 12 shows the components in a rotated position wherein the actuator is in an unlocked condition to accommodate downward movement for dispensing product.

It will be appreciated that the rear guide wall 112 has a generally arcuate surface. However, in the preferred embodiment illustrated, the arcuate surface of the rear guide wall 112 lies on the arc of a circle which has a center that is offset from the center of the generally annular hub 100 per se. Specifically, the closure hub 100 and the actuator 42 both have a common rotational center 113 (FIGS. 11 and 12) lying on a longitudinal axis, but the surface of the rear guide wall 112 lies on the arc of a circle having a center that is offset or displaced from the rotational longitudinal axis or center 113. With reference to FIGS. 11 and 12, the distal edge of the rear guide wall 112 at the first retention surface 114 is thus located further outwardly from the closure center 113 than is the other edge of the rear guide wall 112 at the slot first side 106. The rear guide wall 112 thus effectively projects radially outwardly further with increasing circumferential distance in the clockwise direction as viewed in FIGS. 11 and 12. The increasing outward location of the rear guide wall 112 defines a camming surface for interacting with the actuator 42 as described hereinafter.

Figure 8:
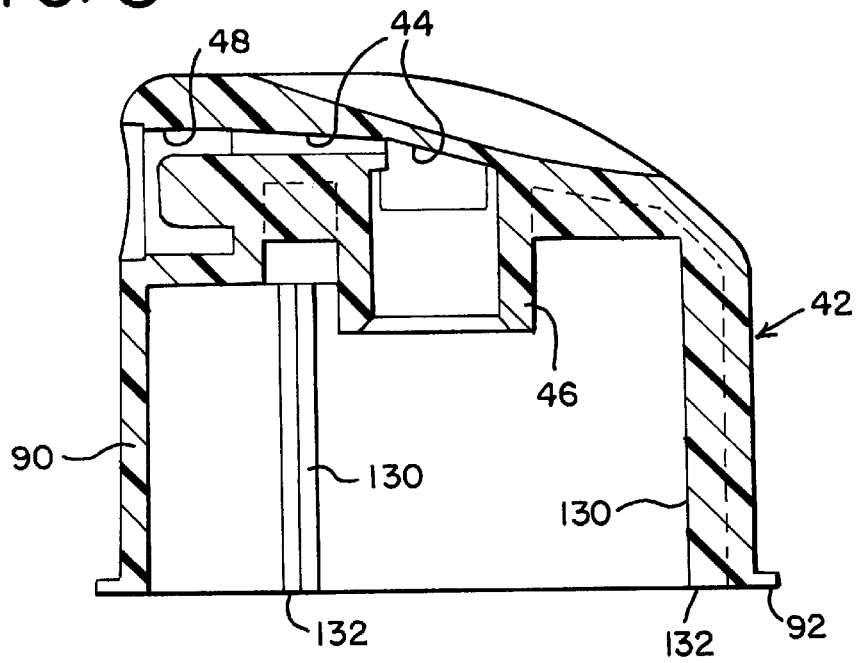
FIG. 8 is a cross-sectional view taken generally along the plane 8—8 in FIG. 7.

The actuator 42 is adapted to cooperate with the closure 26 and is adapted to be rotated between a releasably locked position (FIGS. 6, 9, and 11) in which the actuator 42 cannot be pushed down, and an unlocked position (FIGS. 10 and 12) in which the actuator 42 can be pushed down to actuate the pump. In particular, with reference to FIGS. 7 and 8, the actuator 42 has three ribs 130 which are equally spaced apart circumferentially and which project radially inwardly from the inside of the actuator skirt 90. The ribs 30 are generally axially oriented in the preferred embodiment. Each rib 130 has a lower end surface 132 as shown in FIG. 8 and has, as shown in FIG. 7, lateral surface portions 134, 136, and 138, which define the lateral, vertical surfaces of the rib 130. In the preferred embodiment illustrated, each rib has a three-dimensional shape that is generally a right rectangular prism or parallelepiped, and the lower end surface 132 is a generally rectangular, planar surface.

The skirt 90 of the actuator 42 is preferably molded as a unitary part of the actuator 42 from a suitable thermoplastic material so that the skirt 90 can deflect outwardly by undergoing an elastic deformation when subjected to sufficient outwardly directed radial forces. When the radial forces are released, the skirt 90 returns to the normal, undeflected position illustrated in FIG. 8. This capability for temporary outward deflection of the skirt 90 permits the ribs 130 to be temporarily moved outwardly as the actuator 42 is rotated between the locked and unlocked positions as described in detail hereinafter.

Figure 6:
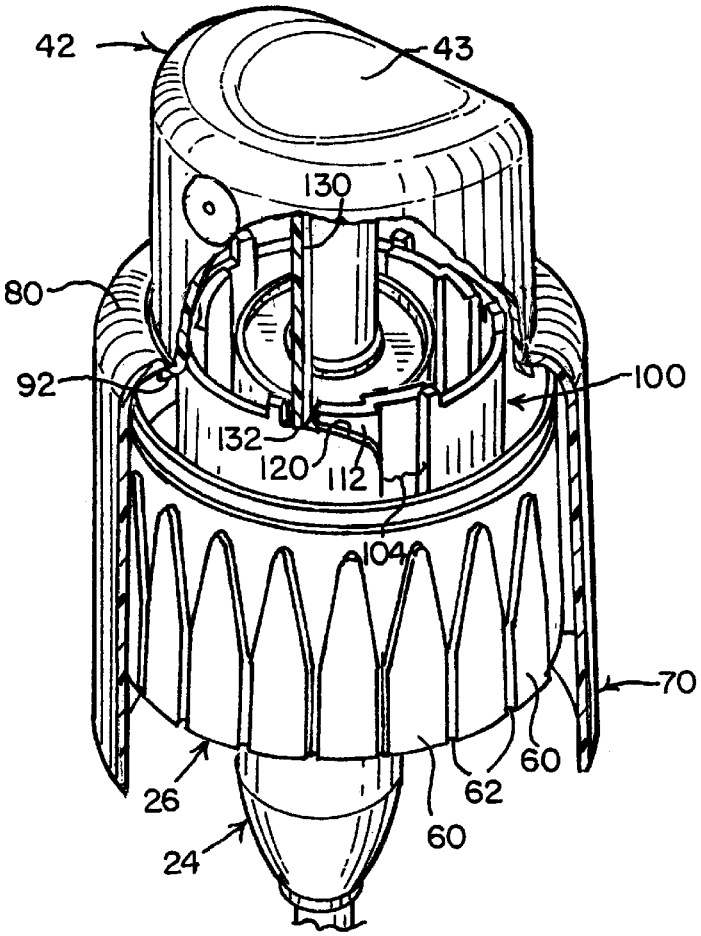
FIG. 6 is a fragmentary, perspective view of the product discharge assembly with portions of the structure cut away to illustrate interior details.
Figure 7:
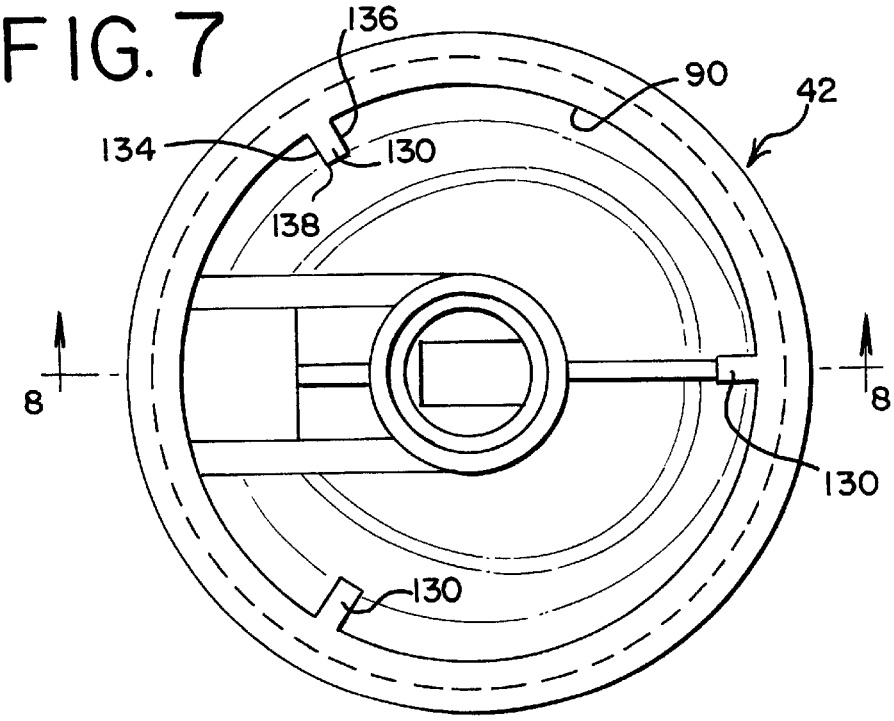
FIG. 7 is a an enlarged bottom plan view of the actuator taken generally along the plane 7—7 in FIG. 2.

FIG. 6 shows the actuator 42 in the locked position wherein the ribs 130 of the actuator prevent the actuator 42 from being pushed downwardly because the lower end surface 132 of each rib 130 engages an abutment surface 120 of the closure hub 100. The enlarged fragmentary, cross-sectional view of FIG. 11 shows one of the ribs 130 in the receiving space between the hub first retention surface 114 and the hub second retention surface 122. FIG. 11 shows the actuator 42 rotated in a counterclockwise direction until the lateral surface 136 of each rib 130 engages the first retention surface 114. The actuator 42 is free to rotate clockwise back toward the second retention surface 122 through a very small arc owing to the fact that the width of each rib 130 is less than the width of the receiving space defined between the two retention surfaces 114 and 122.

If the user attempts to press the actuator 42 downwardly (as by pushing downwardly on the finger-engaging surface 43 in FIG. 6), then the lower end surface 132 of each rib 130 will engage the upwardly facing abutment surface 120 of the closure hub 100 as shown in FIG. 9. This will prevent actuation of the dispensing package.

Typically, the internal spring (not visible) in the pump cartridge 24 biases the pump cartridge 24 and stem 40 upwardly, and the internal pump cartridge structure preferably limits the elevation of the stem 40 to a predetermined unactuated, rest position (FIG. 1). In this elevated rest position, the lower ends 132 of each of the actuator ribs 130 would be raised slightly off of the closure hub abutment surfaces 120. Thus, FIG. 9, which shows the rib lower end surfaces 132 actually engaging the hub abutment surfaces 120, represents a slightly depressed position of the components under the influence of a downward finger force indicated by arrow 140. If the downward force is removed, the actuator 42 would move upwardly slightly as it is carried with the pump cartridge stem 40 to the normal, elevated, rest position under the influence of the pump cartridge internal spring—and that creates a slight gap between the bottom of each rib lower end surface 132 and the underlying hub abutment surface 120. Even in the fully elevated, rest position, the flange 92 at the bottom of the actuator skirt 90 preferably remains spaced slightly below the lip 80 of the shroud 70. However, in an alternate design (not illustrated), the shroud lip 80 could engage the actuator flange 92 so as to establish the maximum, unactuated, rest position elevation of the actuator 42.

When it is desired to actuate the pump, the user must rotate the actuator 42 (in the counterclockwise direction as illustrated in FIGS. 6, 11, and 12). Of course, the actuator 42 could be held stationary and the shroud 70 could instead be rotated in the clockwise direction to rotate the tightly engaged closure 26 in the clockwise direction. In any event, sufficient torque is applied to the components to move the ribs 130 past the first retention surfaces 114 toward the slots 104. There is sufficient flexibility in the system, especially in the ribs 130 and actuator skirt 90, to temporarily and elastically deform the components until the ribs 130 deflect and spring past the first retention surface 114 and become located radially outwardly of, and adjacent, the rear guide wall 112. The radially inwardly facing lateral surface 138 of each rib 130 can then slide along the adjacent rear guide wall 112. As the ribs 130 approach the slots 104, the rotational resistance decreases owing to the decreasing distance of the rear guide wall 112 from the rotational longitudinal axis or center 113.

As the user rotates the actuator 42 away from the locked position (FIG. 11) and begins to push downwardly, the lower end surface 132 of each actuator rib 130 can engage the underlying abutment surface 120. With reference to FIG. 11, as the actuator 42 is rotated in the counterclockwise direction and pushed downwardly, the rib 130 can begin to slide down the steeply curving arcuate portion 120*a* which merges with the near sidewall 106 of the slot 104. FIG. 12 shows the actuator 42 rotated sufficiently so that each rib 130 is located within the vertical slot 104.

Figure 10:
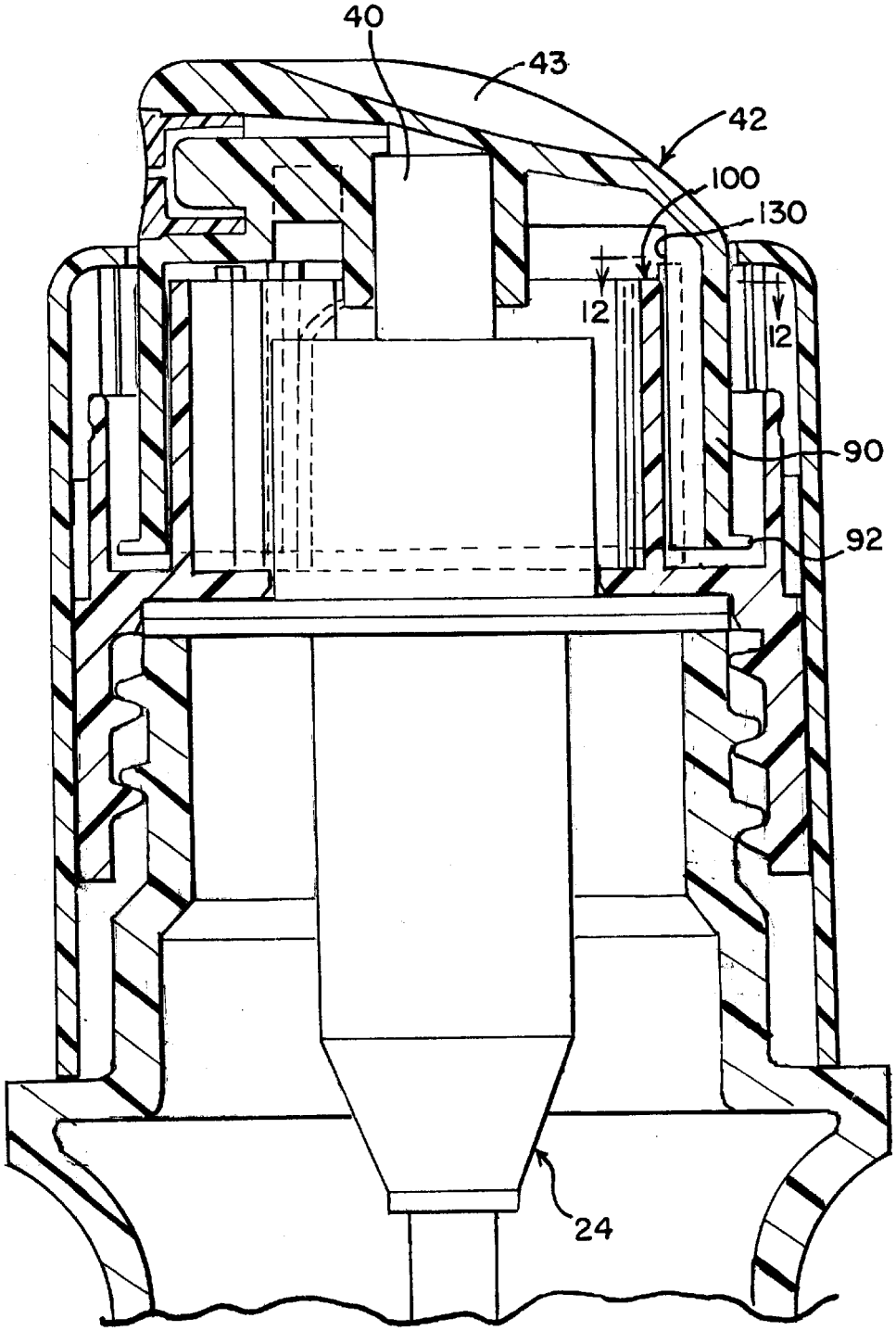
FIG. 10 is a view similar to FIG. 9, but FIG. 10 shows the actuator unlocked and depressed to dispense product.

The user can instead merely rotate the actuator 42 to the unlocked position without also pushing downwardly. In either case, the user will know that the actuator 42 has reached the unlocked position when each rib 130 engages the far sidewall 108 of the slot 104. That prevents further rotation of the actuator 42 in the unlocking direction so that each rib 130 remains located within a slot 104. The actuator 42 can then be depressed fully downwardly to actuate the pump as shown in FIG. 10.

When the downward force is removed from the fully depressed actuator 42, the internal spring (or other biasing mechanism) in the pump cartridge 24 urges the stem 40 and actuator 42 to return to the fully elevated, unactuated, rest position. If the user wishes to again lock the pump to prevent inadvertent discharge, the user may then rotate the actuator 42 back (in a clockwise direction as viewed in FIG. 12). Because the internal biasing mechanism within the pump actuator 24 causes the lower end surfaces 132 of the actuator ribs 130 to be raised slightly above the closure hub abutment surface 120, the actuator 42 can be readily rotated so that the actuator ribs 130 move out of the vertical channel or slot 104 toward the locked position (in the clockwise direction as viewed in FIG. 12). However, as the actuator is rotated further (in the clockwise direction as viewed in FIG. 12) toward the locked position, each rib 130 moves across the front of the rear guide wall 112. It will be recalled that the guide wall 112 extends increasingly radially outwardly with increasing distance from the vertical slot 104 as shown in FIG. 12. Thus, as the rib 130 moves along the rear guide wall 112, the inwardly facing vertical surface 138 of the rib 130 will begin to more forcefully engage the rear guide wall 112. The engagement will be felt by the user as an increasing resistance to rotation of the actuator 42 toward the locked position. This indicates to the user that the actuator 42 is being rotated toward the locked position.

As the actuator 42 is rotated in the clockwise direction toward the locked position, the rear guide wall 112 acts as a cam surface and temporarily, but elastically, deforms or deflects the actuator rib 130 and skirt 90 radially outwardly. Ultimately, after the actuator 42 has been rotated a sufficient distance, the actuator rib 130 just clears or passes the distal side edge of the rear guide wall 112. At that point, the actuator skirt 90 and rib 130 snap radially inwardly adjacent the first retention surface 114. This position is shown in FIG. 11. If the user continues to rotate the actuator 42 further in the clockwise direction (as viewed in FIG. 11), then the rib 130 will engage the second retention surface 122. That will prevent further rotation of the actuator 42 in the clockwise direction viewed in FIG. 11.

When the actuator is in the locked position as shown in FIG. 11, the rib 130 is retained between the first retention surface 114 and second retention surface 122 with the rib lower end surface 132 slightly above the abutment surface 120 so as to prevent substantial downward movement of the actuator. Thus, dispensing from the pump is not possible until the actuator 42 is again moved to the unlocked position. In the locked position, the first retention surface 114 prevents the actuator 42 from being rotated back toward the unlocked position unless a sufficiently high torque is exerted by the user on the actuator 42. The torque is sufficiently high so as to provide a releasable locking system that is not easily unlocked when the package is subjected to inadvertent impact during shipping and handling or if it is dropped.

According to another aspect of the invention, the above-described components may be assembled with a novel method for ultimate installation on a container of fluent material. The method includes the step of providing a finger-operable pump cartridge, such as cartridge 24, that has an outwardly projecting, reciprocatable, product-dispensing stem 40 biased to an elevated rest position and that is adapted to be installed in a mouth of a container that has a connection feature adjacent the mouth. A closure, such as the closure 26, is provided for mounting on the container at the mouth, and the closure has (i) a connection feature for mating with the container connection feature to connect the closure to the container, (ii) a retention feature for engaging a portion of the pump cartridge to retain the pump cartridge on the container, (iii) an opening providing access to the stem from the exterior of the closure, and (iv) a peripheral engagement feature.

The method further includes the step of providing an actuator, such as the actuator 42, for being mounted on the stem 40. The actuator has (i) a dispensing passage for establishing fluid communication between the stem and the exterior of the actuator, (ii) a finger-engageable region that can be subjected to force imposed by a finger to urge the stem further into the pump cartridge, and (iii) a skirt with a flange extending from, and continuously around, the skirt.

The method also includes providing a shroud, such as the shroud 70, having (i) a central cavity open at opposite ends for receiving the closure and actuator mounted on the stem, (ii) an internal engagement feature for engaging a closure peripheral engagement feature to secure the shroud to the closure, and (iii) a lip for engaging the actuator flange to inhibit removal of the actuator from the stem if the actuator is moved outwardly relative to the stem beyond a predetermined position.

The method includes the steps of disposing the pump cartridge in the closure, installing the actuator on the stem, and securing the shroud to the closure with at least portions of the pump cartridge, actuator, and closure received in the shroud central cavity to orient the shroud lip above the actuator flange. If desired, a dip tube can be installed on the pump cartridge where the pump cartridge is of the type that uses a dip tube.

The product discharge assembly as thus assembled according to the above-described method may then be delivered to a filling line in which a container is filled so that the assembly can then be installed on the container at termination of the filling process. This may be performed manually or with conventional, automatic equipment.

In a preferred method for automatically assembling the components, use is made of the arrangement of the closure protuberances 60 (FIG. 3) which are arranged in two groups separated by spaces or gaps 75. This allows the closure 26 to be gripped automatically by a machine according to a specific orientation within that machine relative to the two closure spaces or gaps 75. Then the machine accommodates insertion of the pump cartridge 24 into the closure 26 (in any rotational orientation of the pump cartridge 24).

Subsequently, the machine, while still holding the closure 26 in the specific orientation relative to the spaces or gaps 75, mounts the actuator 42 on the pump cartridge stem 40 so that the actuator 42 has a particular rotational orientation relative to the closure gaps 75 so as to define a predetermined orientation of the actuator spray button orifice relative to the closure 26.

Subsequently, the machine installs the assembly (of the threaded closure 26, pump cartridge 24, and actuator 42) on a threaded (and filled) container by (1) initially orienting the assembly at a particular orientation relative to the shape or front of the container 22, and (2) then rotating the assembly to engage the container thread 32 with the thread 54 of the closure 26 such that after a predetermined rotational engagement of the assembly to a fully installed condition (as determined by a torque limit sensor, for example), the actuator spray orifice will be oriented substantially at the front of the bottle (or at some other orientation as may be predetermined).

The above-discussed automatic assembly according to a predetermined orientation based on the closure gap or space 75 between the two sets of the protuberances 60 is a conventional process, the details of which form no part of the present invention. Indeed, a particular orientation is not desired, or if it is desired to effect orientation of the components and/or container in some other manner, the gap 75 between two sets of protuberances may be eliminated.

Further, the use of the tapering protuberances 60 and interengaging shroud ribs 82 is a conventional method for applying a shroud to a closure. Other suitable special or conventional engaging structures for attaching a shroud to a closure may be employed if desired.

Further, the structures and method for attaching or mounting the pump cartridge 24 to the container with the closure 26 are generally conventional. The present invention contemplates that other structures and methods for mounting a pump cartridge within a closure on a container may be employed. The principles of the novel aspects of the present invention can be employed with pump cartridges having a variety of pump heights and external configurations.

It will be appreciated that although the illustrated preferred form of the releasable actuator locking system includes the three sets of ribs 130 on the actuator 42 for cooperating with three sets of locking and unlocking features 102 in the closure 26, only one set of cooperating features need be provided instead of three. Alternatively, more than three sets of cooperating features could be provided. Of course, according to another aspect of the invention in which the actuator flange 92 and shroud 70 cooperate to retain the actuator 42 on the pump cartridge stem 40, the releasable actuator locking system may be optionally omitted altogether if such a feature is not desired in a particular application.

It will be readily apparent from the foregoing detailed description of the invention and from the illustrations thereof that numerous variations and modifications may be effected without departing from the true spirit and scope of the novel concepts or principles of this invention.

What is claimed is:

1. A product discharge assembly for a container of fluent material, said assembly comprising:

(A) a finger-operable pump cartridge that (i) has an outwardly projecting, reciprocatable, product-dispensing stem biased to an elevated rest position, and (ii) is adapted to be installed in a mouth of a container that has a connection feature adjacent the mouth;

(B) a closure for mounting on said container at said mouth and having (i) a connection feature for mating with said container connection feature to connect said closure to said container, (ii) a retention feature for engaging a portion of said pump cartridge to retain said pump cartridge on said container, (iii) an opening into which said pump cartridge can project, and (iv) a peripheral engagement feature;

(C) an actuator that is adapted for being mounted on said stem and that has (i) a dispensing passage for establishing fluid communication between said stem and the exterior of said actuator, (ii) a finger-engageable region that can be subjected to force imposed by a finger to urge said stem further into said pump cartridge, and (iii) a skirt with a flange extending radially outwardly from, and continuously around, said skirt; and (D) a shroud having (i) a central cavity open at opposite ends for receiving said closure and actuator mounted on said stem, (ii) an internal engagement feature for engaging said closure peripheral engagement feature to secure said shroud to said closure, and (iii) a lip for engaging said actuator flange to inhibit removal of said actuator from said stem if said actuator is moved outwardly relative to said stem beyond a predetermined position.

2. The assembly in accordance with claim 1 adapted to be installed in a mouth of a container having a male thread around said opening to define said container connection feature and in which said closure has a female thread defining said connection feature for mating with said container male thread.

3. The assembly in accordance with claim 1 in which said assembly is adapted for use with a container having a rim around said container mouth;

said pump cartridge includes a peripheral flange; and said closure has an inwardly projecting flange to define said retention feature wherein said inwardly projecting flange is adapted to overlie said pump cartridge flange and to clamp said pump cartridge flange against said container rim.

4. The assembly in accordance with claim 1 in which said closure peripheral engagement feature includes a plurality of spaced-apart anchoring protuberances wherein two adjacent protuberances define a groove with a tapered end entrance; and said shroud internal engagement feature includes a plurality of ribs wherein each rib is adapted to be received within one of said grooves in tight engagement to hold said shroud on said closure.

5. The assembly in accordance with claim 1 adapted to be installed on a container having a rim around said mouth, said assembly further including:

(i) a dip tube extending from the bottom of said pump cartridge; and (ii) a gasket for sealing a portion of said pump cartridge to said container rim.

6. The assembly in accordance with claim 1 in which said actuator is generally cylindrical and in which said flange is a generally annular, continuous flange extending outwardly from the bottom edge of said skirt.

7. The assembly in accordance with claim 1 in which said shroud has a generally cylindrical, annular wall with said lip extending radially inwardly from the top edge of said generally cylindrical wall.

8. The assembly in accordance with claim 1 in which said actuator and said closure have interengageable features accommodating rotation of said actuator relative to said closure between an actuatable position permitting reciprocation of said actuator and a releasably locked position preventing reciprocation of said actuator.

9. The assembly in accordance with claim 8 in which said actuator includes a generally axially oriented rib that (i) projects radially inwardly from said actuator skirt, (ii) has a lower end surface, and (iii) has lateral surface portions; and a closure that defines (i) a slot that (a) opens radially outwardly and is oriented generally parallel to the actuator reciprocation directions for receiving said rib, and (b) is defined at least in part by two spaced-apart sidewalls, (ii) a generally axially oriented rear guide wall extending from said slot to a first circumferential location from said slot where said rear guide wall terminates in a first retention surface, (iii) an abutment surface that (a) extends from said slot to a second circumferential location that is further from said slot than is said first circumferential location, and (b) has an arcuate portion merging with one of said slot sidewalls, and (iv) a second retention surface projecting from said abutment surface at said second circumferential location to define a receiving space between said first and said second retention surfaces, said rear guide wall deflecting said rib radially outwardly as said actuator is rotated to move said rib toward said space whereby said rib is resiliently urged into said receiving space when said rib has been rotated past said first retention surface.

10. The assembly in accordance with claim 1 in which said rear guide wall defines a cam surface projecting further radially outwardly with increasing distance from said slot so that said rib engages said cam surface with increasing force as said rib moves along said cam surface from said slot toward said receiving space.

11. A method for making a product discharge assembly for a container of fluent material, said method comprising the steps of:

(A) providing a finger-operable pump cartridge that (i) has an outwardly projecting, reciprocatable, product-dispensing stem biased to an elevated rest position, and (ii) is adapted to be installed in a mouth of a container that has a connection feature adjacent the mouth;

(B) providing a closure that is adapted for mounting on said container at said mouth and that has (i) a connection feature for mating with said container connection feature to connect said closure to said container, (ii) a retention feature for engaging a portion of said pump cartridge to retain said pump cartridge on said container, (iii) an opening into which said pump cartridge can project, and (iv) a peripheral engagement feature;

(C) providing an actuator for being mounted on said stem and having (i) a dispensing passage for establishing fluid communication between said stem and the exterior of said actuator, (ii) a finger-engageable region that can be subjected to force imposed by a finger to urge said stem further into said pump cartridge, and (iii) a skirt with a flange extending radially outwardly from, and continuously around, said skirt; and (D) providing a shroud having (i) a central cavity open at opposite ends for receiving said closure and actuator mounted on said stem, (ii) an internal engagement feature for engaging said closure peripheral engagement feature to secure said shroud to said closure, and (iii) a lip for engaging said actuator flange to inhibit removal of said actuator from said stem if said actuator is moved outwardly relative to said stem beyond a predetermined position;

(E) disposing said pump cartridge in said closure;

(F) installing said actuator on said stem; and (G) securing said shroud to said closure with at least portions of said pump cartridge, actuator, and closure received in said shroud central cavity to orient said shroud lip above said actuator flange.

12. The method in accordance with claim 11 further including installing a dip tube on said pump cartridge.

13. A product discharge assembly for a container of fluent material, said assembly comprising:

(A) a finger-operable pump cartridge that (i) has an outwardly projecting, reciprocatable, product-dispensing stem biased to an elevated rest position, and (ii) is adapted to be installed in a mouth of a container that has a connection feature adjacent the mouth;

(B) an actuator that is adapted for being mounted on said stem and that includes (i) a dispensing passage for establishing fluid communication between said stem and the exterior of said actuator, (ii) a skirt spaced outwardly of, and extending around, said pump cartridge stem, and (iii) a generally axially oriented rib that (a) projects radially inwardly from said actuator skirt, (b) has a lower end surface, and (c) has a lateral surface portions; and (C) a closure for mounting on said container at said mouth and having (i) a connection feature for mating with said container connection feature to connect said closure to said container, (ii) a retention feature for engaging a portion of said pump cartridge to retain said pump cartridge on said container, (iii) an opening into which the pump cartridge can project, (iv) a slot that (a) opens radially outwardly and is oriented generally parallel to the actuator reciprocation directions for receiving said rib, and (b) is defined at least in part by two spaced-apart sidewalls, (v) a generally axially oriented rear guide wall that (a) extends laterally from said slot to a first circumferential location from said slot where said rear guide wall terminates in a first retention surface, and (b) defines a cam surface projecting further radially outwardly with increasing distance from said slot so that said rib engages said cam surface with increasing force as said rib moves along said cam surface away from said slot, (vi) an abutment surface that (a) extends from said slot to a second circumferential location that is further from said slot than is said first circumferential location, and (vii) a second retention surface projecting from said abutment surface at said second circumferential location to define a receiving space between said first and said second retention surfaces, said rear guide wall cam surface deflecting said rib radially outwardly as said actuator is rotated to move said rib toward said receiving space whereby said rib is resiliently urged into said receiving space between said first retention surface and said rib is resiliently urged into said receiving space between said first retention surface and said second retention surface when said rib has been rotated past said first retention surface.

14. The assembly in accordance with claim 13 adapted to be installed in a mouth of a container having a male thread around said opening to define said container connection feature and in which said closure has a female thread defining said connection feature for mating with said container male thread.

15. The assembly in accordance with claim 13 in which said assembly is adapted for use with a container having a rim around said container mouth;

said pump cartridge includes a peripheral flange; and said closure has an inwardly projecting flange to define said retention feature wherein said inwardly projecting flange is adapted to overlie said pump cartridge flange and to clamp said pump cartridge flange against said container rim.

16. The assembly in accordance with claim 13 in which said closure has a peripheral engagement feature that includes a plurality of spaced-apart anchoring protuberances wherein two adjacent protuberances define a groove with a tapered end entrance; and said shroud has an internal engagement feature that includes a plurality of ribs wherein each rib is adapted to be received within one of said grooves in tight engagement to hold said shroud on said closure.

17. The assembly in accordance with claim 13 adapted to be installed on a container having a rim around said mouth, said assembly further including:

(i) a dip tube extending from the bottom of said pump cartridge; and (ii) a gasket for sealing a portion of said pump cartridge to said container rim.

18. The assembly in accordance with claim 13 in which said actuator is generally cylindrical and in which said flange is a generally annular, continuous flange extending outwardly from the bottom edge of said skirt.

19. The assembly in accordance with claim 13 in which said shroud has a generally cylindrical, annular wall with said lip extending radially inwardly from the top edge of said generally cylindrical wall.

* * * * *